US006881041B2

(12) United States Patent
Lee

(10) Patent No.: US 6,881,041 B2
(45) Date of Patent: Apr. 19, 2005

(54) COMPRESSOR WITHIN MOTOR ROTOR

(75) Inventor: Chang-Soo Lee, Gimhae (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/380,278

(22) PCT Filed: Dec. 6, 2002

(86) PCT No.: PCT/KR02/02301

§ 371 (c)(1),
(2), (4) Date: Mar. 12, 2003

(87) PCT Pub. No.: WO2004/005719

PCT Pub. Date: Jan. 15, 2004

(65) Prior Publication Data

US 2004/0005236 A1 Jan. 8, 2004

(30) Foreign Application Priority Data

Jul. 2, 2002 (KR) ..... 2002-38016

(51) Int. Cl.[7] ..... F04B 17/03; F04C 18/00

(52) U.S. Cl. ..... 417/356; 417/410.3; 418/162; 418/177; 418/219

(58) Field of Search ..... 417/355, 356, 417/410.3; 418/63, 162, 177, 219, 187

(56) References Cited

U.S. PATENT DOCUMENTS

| | | | | | |
|---|---|---|---|---|---|
| 1,198,343 | A | * | 9/1916 | Gillespie | 418/162 |
| 2,644,635 | A | * | 7/1953 | Warrick et al. | 417/356 |
| 3,186,347 | A | * | 6/1965 | Eickmann | 418/187 |
| 6,244,835 | B1 | * | 6/2001 | Antaki et al. | 417/356 |

FOREIGN PATENT DOCUMENTS

| | | | | |
|---|---|---|---|---|
| JP | 1-310190 | * | 12/1989 | 417/356 |
| JP | 2-9982 | * | 1/1990 | 418/177 |

* cited by examiner

*Primary Examiner*—John J. Vrablik
(74) *Attorney, Agent, or Firm*—Fleshner & Kim, LLP

(57) ABSTRACT

A compressor comprises a sealed chamber to which a suction pipe and a discharge pipe are communicated, a motor unit fixed in the sealed chamber and consisting of a stator and a rotor for generating rotating force by electromagnetic interaction between the stator and rotor, and a compression unit sucking, compressing and discharging compressible fluid according regular volume change and opening/closing of valve caused by rotating force of the motor unit, wherein the compression unit is disposed in the rotor to miniaturize and lighten the compressor, to reduce input energy of the motor unit, and to reduce vibration noise.

12 Claims, 12 Drawing Sheets

COMPRESSOR WITHIN MOTOR ROTOR

TECHNICAL FIELD

The present invention relates to a compressor using a vane, and particularly, to a compressor of which a structure is simplified to reduce a volume, weight and production cost of the compressor.

BACKGROUND ART

Generally, a compressor is a device for changing a mechanical energy into a compressive energy of compressible fluid. And a refrigerating compressor can be classified into a reciprocating compressor, a scroll compressor, a centrifugal type compressor, and a rotary compressor.

Among those compressors, a compressor which reciprocates in a compression space, in which a volume is formed eccentrically, and divides the compression space into a suction area and a compression area will be described as follows.

FIG. 1 is a longitudinal cross-sectional view showing an example of the compressor according to the conventional art, and FIG. 2 is a cut perspective view showing a compression unit of the compressor in FIG. 1.

The compressor shown in FIGS. 1 and 2 was developed and applied to Korean Intellectual Property Office (application No. 10-1999-0042381, date Oct. 1, 1999) by the present applicant, and registered on Korean Intellectual Property Office at Nov. 14, 2001 (registration No. 10-0315954).

As shown in FIGS. 1 and 2, the compressor according to the conventional art can be classified as the rotary compressor, and comprises: a sealed chamber 10 to which a suction pipe 1 and a discharge pipe 2 are connected; a motor unit 12 disposed in the sealed chamber 10 to generate rotary force; and a compression unit 14 disposed in the sealed chamber 10 to be apart a predetermined distance from the motor unit 12 for sucking, compressing and discharging compressible fluid by the rotary force generated in the motor unit 12.

The motor unit 12 comprises: a stator 16 fixedly adhered on an inner circumferential surface of the sealed chamber 10 same as general electric motor, and a rotor 18 disposed to maintain a predetermined air gap from an inner circumferential surface of the stator 16 and rotated by an electromagnetic interaction with the stator 16.

The compression unit 14 comprises: a cylinder assembly 31 disposed in the sealed chamber 10 for forming a compression space (V) in which the sucked compressible fluid is compressed on outer part; a rotary shaft 20 fixed on the cylinder assembly 31 to be rotatable and fixedly adhered to an inner circumferential surface of the rotor to be rotated with the rotor 18 when the rotor 18 is rotated; a cam member 23 rotating with the rotary shaft 20 as coupled to the rotary shaft 20 and dividing the compression space (V) in the cylinder assembly 31 into a first space (V1) and a second space (V2); a first vane 60 and a second vane 70 contacted to upper and lower sides of the cam member 23 for reciprocating toward inner and outer sides of the compression space (V) along with a cam surface of the cam member 23 when the cam member 23 is rotated and dividing the first and second spaces (V1 and V2) into suction areas and compression areas respectively.

The cylinder assembly 31 comprises a cylinder 30, and a first and a second bearing plates 40 and 50 fixed on both sides of the cylinder 30 for forming the compression space (V) with the cylinder 30.

The first and second bearing plates 40 and 50 are formed as discs having predetermined thickness and area, and comprise: journal portions 42 and 52, which are extended and penetrate centers of the discs to have predetermined heights and outer diameters, having the rotary shaft 20 inserted therein to be rotatable, and a first and a second vane slots 44 and 54 formed on one sides of the journal portions 42 and 52 for guiding the reciprocating movements of the first and second vanes 60 and 70.

Herein, the first and second vane slots 44 and 54 are formed as square holes corresponding to sizes of the first and second vanes 60 and 70 from outer circumferences of the first and the second bearing plates 40 and 50 toward center sides.

The rotary shaft 20 is formed to have a certain outer diameter and a predetermined length, and consists of a shaft portion 21 inserted into the first and second bearing plates 40 and 50 and into the journal portions 42 and 52, and a hub portion 22 extendedly formed on one side of the shaft portion 21 to be coupled to the cam member 23 in the cylinder assembly 31.

The cam member 23 is formed as a disc when it is projected on a plane so that the outer circumferential surface thereof is slidably contacted to the inner circumferential surface of the cylinder 30, and is formed as a cam surface of sinuous wave having same thickness from the inner circumferential surface to the outer circumferential surface when a side surface thereof is projected. And the surface making an top dead center (D1) is rotated as sliding on a bottom surface of the first bearing plate 40, and the surface making a bottom dead center (D2) is rotated as sliding on an upper surface of the second bearing plate 50.

The first and second vanes 60 and 70 are formed as square plates, and disposed to be adhered to the sinuous wave of the cam member 23 in the compression space (V) of the cylinder assembly 31.

Also, the first and the second vanes 60 and 70 are elastically supported by an elastic supporting member 90 mounted on the first and second bearing plates 40 and 50, respectively.

Therefore, the first and the second vanes 60 and 70 respectively divide the compression spaces (V1 and V2) into the suction areas and the compression areas as reciprocating up-and-down direction along with the height of the cam surface of the cam member 23, when the cam member 23 is rotated.

Also, a first discharge muffler 46 and a second discharge muffler 56 are fixed respectively on upper side of the first bearing plate 40 and on lower side of the second bearing plate 50, so as to reduce discharge noise of fluid which is discharged after compressed.

Operations of the compressor according to the conventional art constructed as above will be described as follows.

First, when the rotary shaft 20 is rotated by the rotating force of the motor unit 12, the cam member 23 coupled to the rotary shaft 20 in the cylinder assembly 31 is also rotated.

At that time, the first space (V1) located on upper part of the cam member 23 is divided into the suction area and the compression area as making the top dead center (D1) and the first vane 60 boundaries, and the second space (V2) located on the lower part of the cam member 23 is also divided into the suction area and the compression area as making the bottom dead center (D2) and the second vane 70 of the cam member 23 boundaries.

In above status, the cam member 23 is rotated, and thereby the top dead center (D1) and the bottom dead center (D2) of the cam member 23 are moved and the volumes of the suction areas and of the compression areas of the first and second spaces (V1 and V2) are variable.

At that time, the first vane 60 and the second vane 70 reciprocate toward opposite directions of each other for the cam surface height of the cam member 23.

Therefore, when the top dead center (D1) or the bottom dead center (D2) of the cam member 23 reaches to a discharge starting point after the compressible fluid is sucked into the respective suction areas of the first and second spaces (V1 and V2) simultaneously through the suction passage 1 and gradually compressed, at the same time, the compressed fluid is discharged out of the cylinder assembly 31 through discharge passages (not shown) of the respective compression spaces (V1 and V2).

In addition, the fluid discharged as above passes through the respective discharge mufflers 46 and 56 and the sealed chamber 10, and exhausted out of the compressor through the discharge pipe 2.

On the other hand, another examples of the conventional compressor will be described with reference to FIGS. 3 and 4 as follows. FIG. 3 is a longitudinal cross-sectional view showing another example of the conventional compressor, and FIG. 4 is a cross-sectional view in line IV–IV direction of FIG. 3.

As shown in FIGS. 3 and 4, the compressor according to the conventional art comprises: a sealed case 110 connected to a suction pipe 101 and to a discharge pipe 102, and making an outer case of the compressor; a motor unit 112 comprising a stator 116 fixedly adhered to an inner circumferential surface of the sealed chamber 110 and a rotor 118 installed inside the stator 116; and a compression unit 114 for sucking, compressing and discharging compressible fluid by being transmitted the rotating force of the motor unit 112.

The compression unit 114 comprises: a cylinder assembly 131 disposed in the sealed chamber 110 for forming a compression space (V) in which the compressible fluid which is sucked from outer side is compressed; a rotary shaft 120 comprising a shaft portion 121 press-fitted into the inner circumferential surface of the rotor 118 and an eccentric portion 122 formed to be eccentric for the shaft portion 121 in the compression space (V), coupled to the cylinder assembly 131 to be rotatable and rotated with the rotor 118; a cam member 123 connected to an outer circumferential surface of the eccentric portion 122 of the rotary shaft 120 to be contacted to an inner diameter of the cylinder assembly 131 for rotating and revolving centering around the rotary shaft 120; and a vane 160 reciprocating along with a cam surface of the cam member 123 for dividing the compression space (V) into a suction area and a compression area.

The cylinder assembly 131 comprises a cylinder 130 and a first and second bearing plates 140 and 150 fixed on both sides of the cylinder 130 for forming the compression space (V) with the cylinder 130.

A vane slot 144 for guiding the reciprocating movements of the vane 160 is formed as cut in the cylinder 130, and an elastic supporting means 190 for elastically supporting the vane 160 from outer part of the vane slot 144 is disposed.

In addition, a discharge passage 185 through which the compressed fluid is discharged is formed on one side of the inner circumferential surface where the cylinder 130 and the first and second bearing plates 140 and 150 are contacted.

Also, the first and second bearing plates are formed as disc having predetermined thickness and area, and journal portions 142 and 152, to which the rotary shaft 120 is inserted therein to be rotatable, extended and penetrated on center portion to have predetermined height and outer diameter.

Operations of the another example of compressor according to the conventional art will be described as follows.

When electric power is applied to the stator 116 and the rotor 118 is rotated, the rotary shaft 120 which is press-fitted and fixed on the inner circumferential surface of the rotor 118 is rotated so that the cam member 123 coupled to the eccentric portion 122 of the rotary shaft 120 is rotated in the cylinder assembly 131 in a state that the cam member 123 is contacted to the vane 160.

In above status, the cam member 123 is rotated, and thereby volumes of the suction area and the compression area made by the cam member 123 and the vane 160 are variable.

Therefore, the compressible fluid is sucked into the compression space (V) of the cylinder assembly 131 through a suction hole 101, and compressed. In addition, the fluid compressed as above is discharged out of the cylinder assembly 131 through the discharge passage 185, and discharged out of the sealed chamber 110 through the discharge hole 102.

In the compressor constructed and operated as above according to the conventional art, the motor unit and the compression unit are installed on upper and lower parts with a certain distance therebetween, and therefore, size of the compressor is increased in length direction and the cam member is coupled as apart a predetermined distance from the center of the rotor, and therefore, the transmission length of the rotating force which is generated by the rotor is increased.

That is, as the transmission length of the rotating force is increased as described above, loss of power is generated, and efficiency of the compressor for inputted energy into the rotor is lowered.

Also, as the transmission length of the rotating power is increased as above, the moment of inertia is increased, and accordingly, vibration noise of the compressor is also increased.

On the other hand, in order to reduce the moment of inertia on the rotary shaft, the journal portions are formed on the first and second bearing plates for supporting the rotary shaft, however, frictional loss between the outer circumferential surface of the rotary shaft and the inner circumferential surface of the journal portions is increased, and the efficiency of the compressor is also decreased.

Also, the device, in which the compressor is installed, becomes compact and low weight, and production cost is reduced. Accordingly, the size of the compressor is also needed to be reduced under same function. However, the conventional compressor is formed long in the length direction, and therefore, a lot of installation space is required for the compressor.

DISCLOSURE OF THE INVENTION

Therefore, it is an object of the present invention to provide a compressor with a simple structure and a small size by disposing a compression unit in a rotor of a motor unit to make a stator and a cylinder assembly a single body.

To achieve the object of the present invention, there is provided a compressor comprising: a sealed chamber to which a suction pipe and a discharge pipe are connected; a motor fixed in the sealed chamber for generating a rotating force by an electromagnetic interaction of a stator and a rotor therein; a cylinder assembly fixed on an inner circumferential surface of the rotor to rotate with the rotor, forming a compression space therein; a supporting shaft having both ends fixed on inner surface of the sealed chamber to support the cylinder assembly to be rotatable, a suction passage for supplying fluid into the compression space and a discharge passage for discharging compressed fluid; a cam member fixed on the supporting shaft and located on inner side of the cylinder assembly; and a vane fixed on the inner surface of the cylinder assembly to be rotated with the cylinder assembly for sucking the fluid into the compression space while rotating as adhered to upper and lower surfaces of the cam member, compressing the fluid, and discharging the fluid through the discharge passage.

MODES FOR CARRYING OUT THE PREFERRED EMBODIMENTS

Hereinafter, preferred embodiments of a compressor according to the present invention will be described with reference to accompanying Figures as follows.

Figure 1:
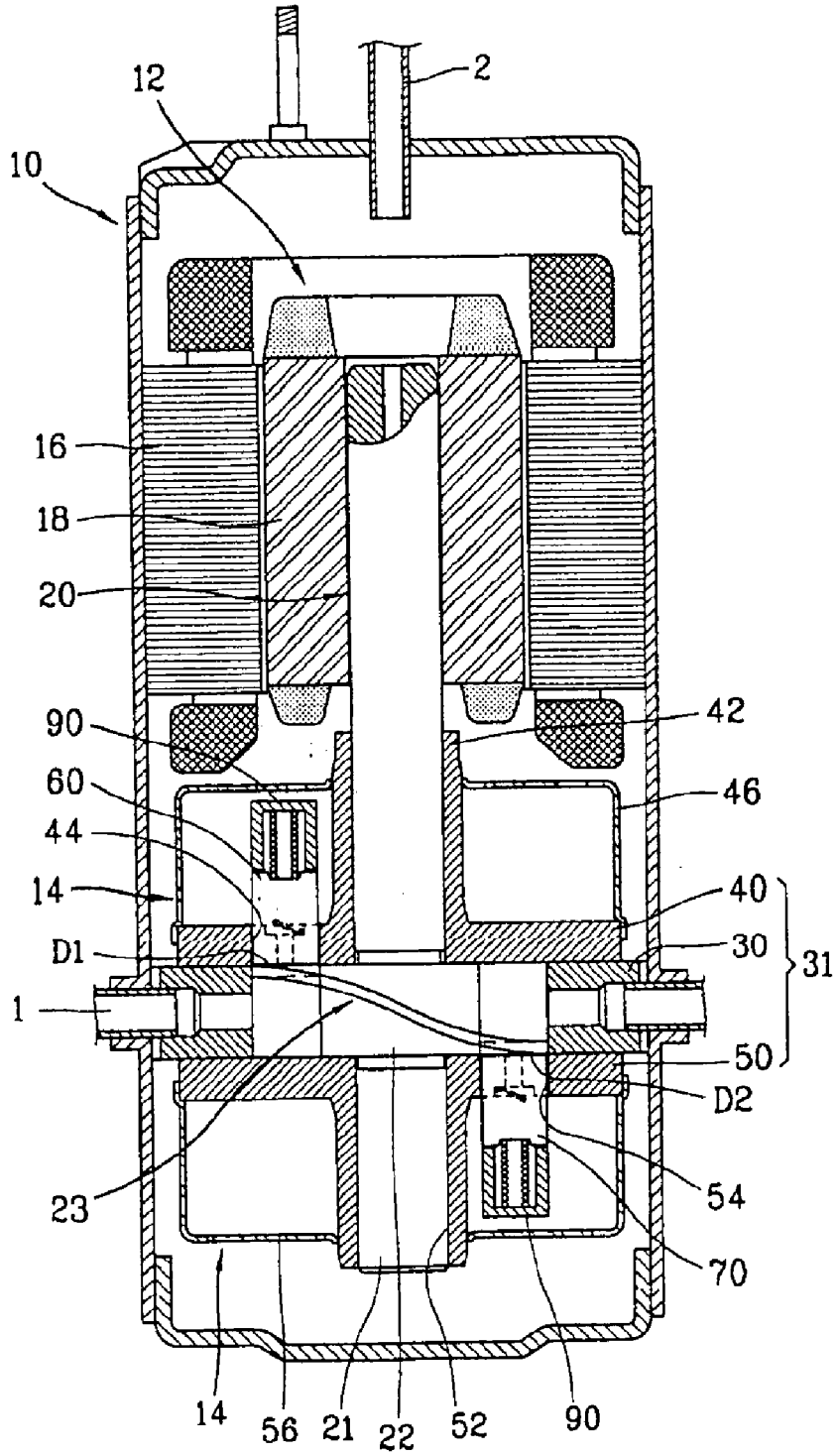
FIG. 1 PRIOR ART
FIG. 1 is a longitudinal cross-sectional view showing an example of a compressor according to the conventional art.
Figure 2:
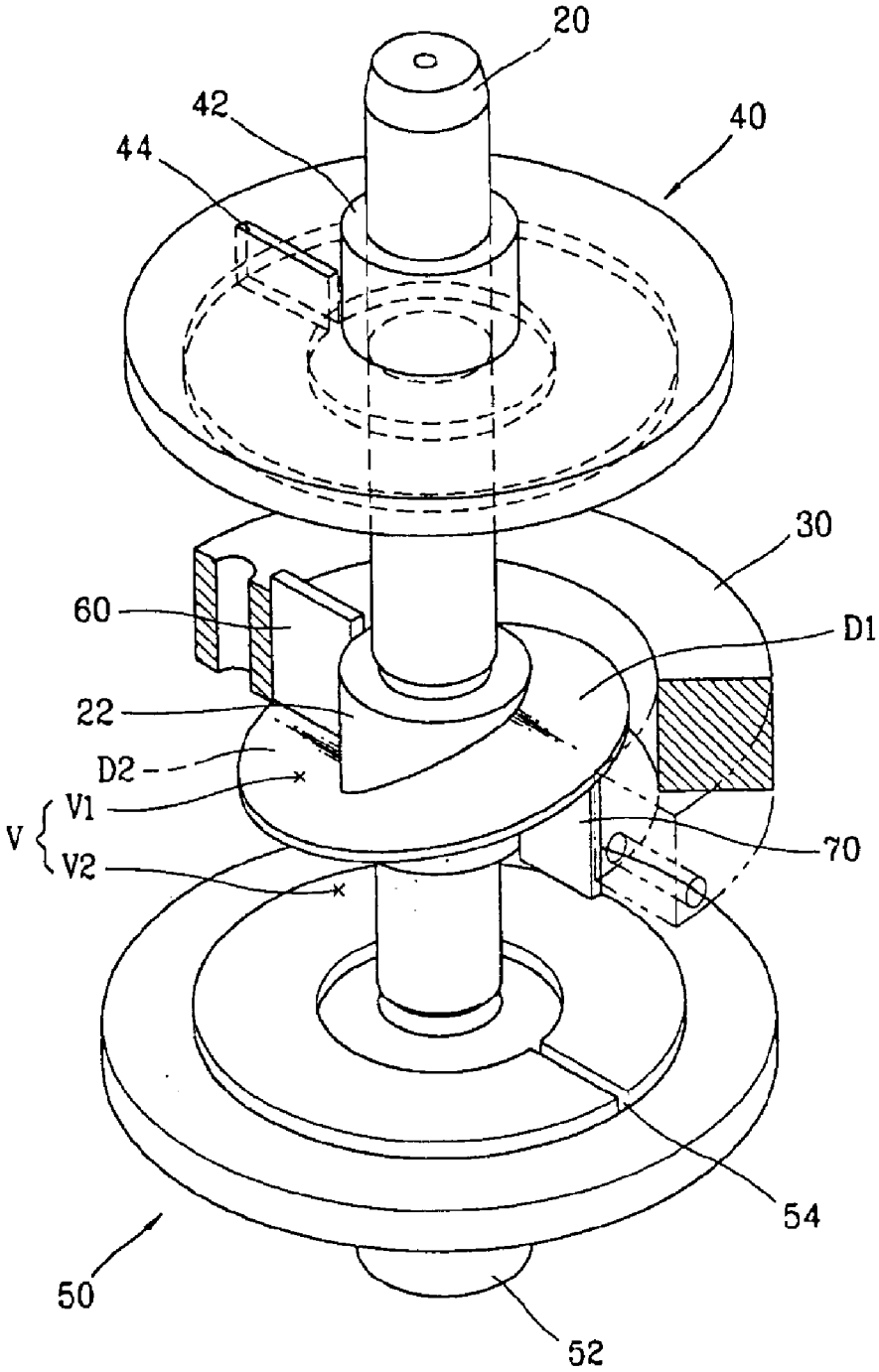
FIG. 2 PRIOR ART
FIG. 2 is a perspective view showing a part of a compression unit in the conventional compressor shown in FIG. 1.
Figure 3:
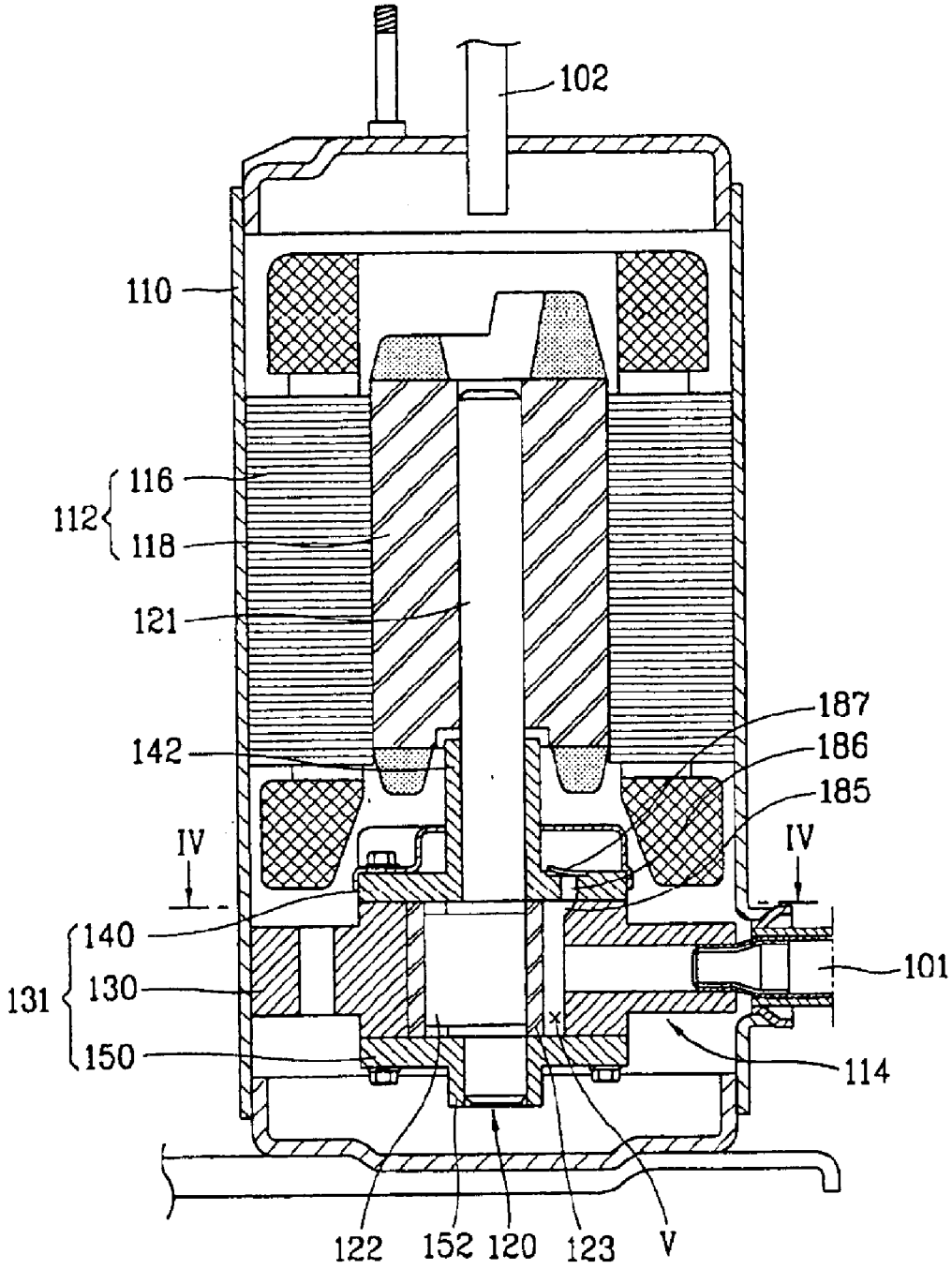
FIG. 3 PRIOR ART
FIG. 3 is a longitudinal cross sectional view showing another example of the compressor according to the conventional art.
Figure 4:
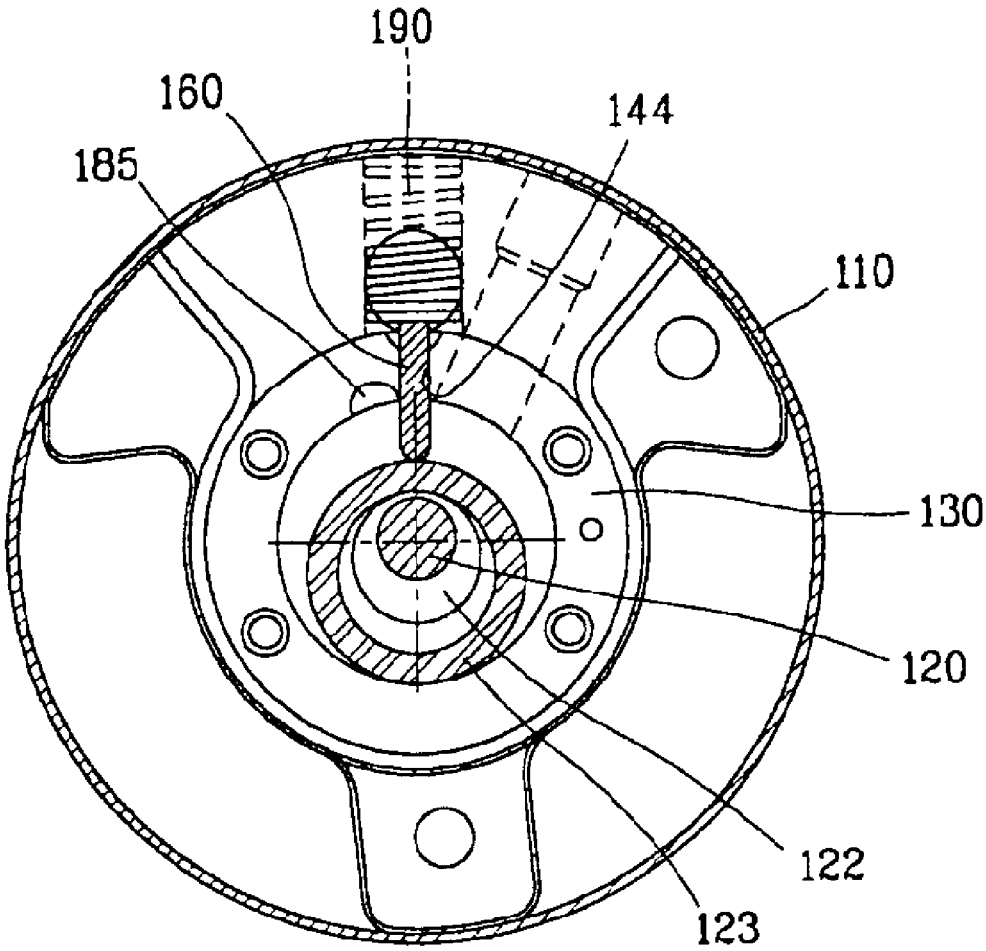
FIG. 4 PRIOR ART
FIG. 4 is a cross-sectional view in line IV—IV direction in FIG. 3.
Figure 5:
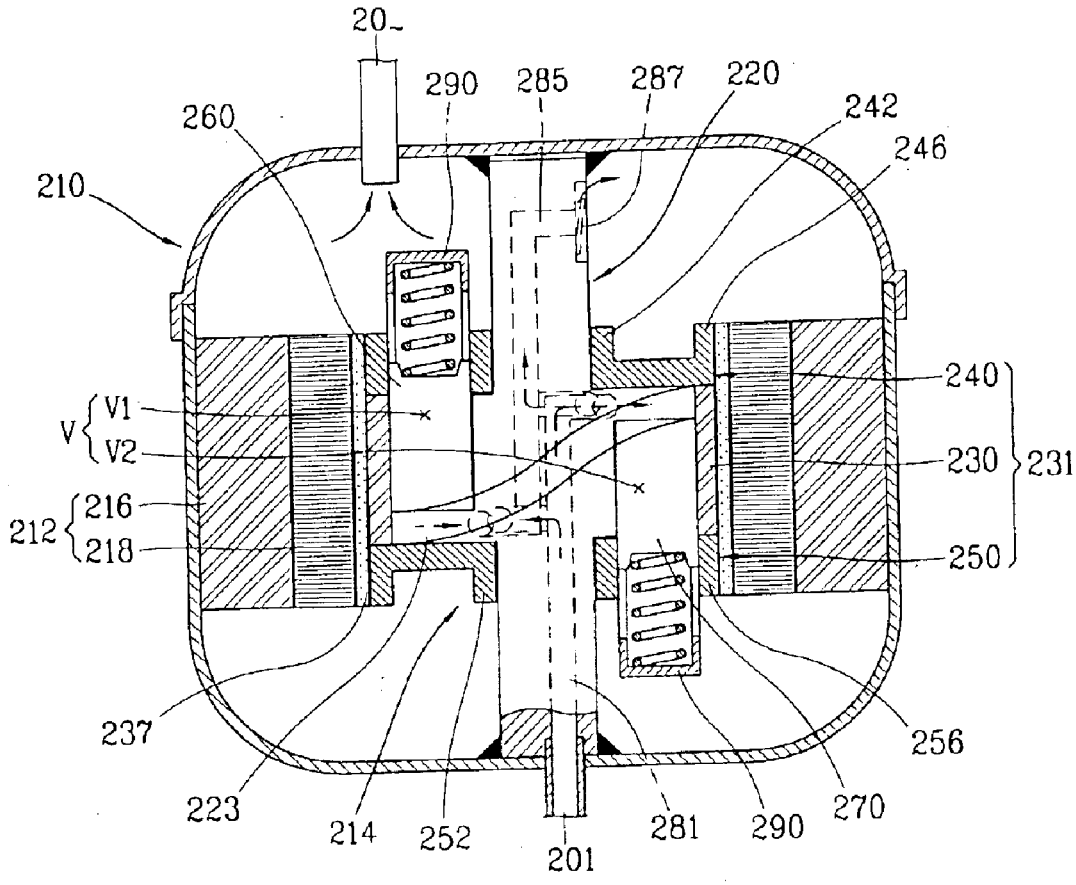
FIG. 5 is a longitudinal cross-sectional view showing a compressor according to an embodiment of the present invention.
Figure 6:
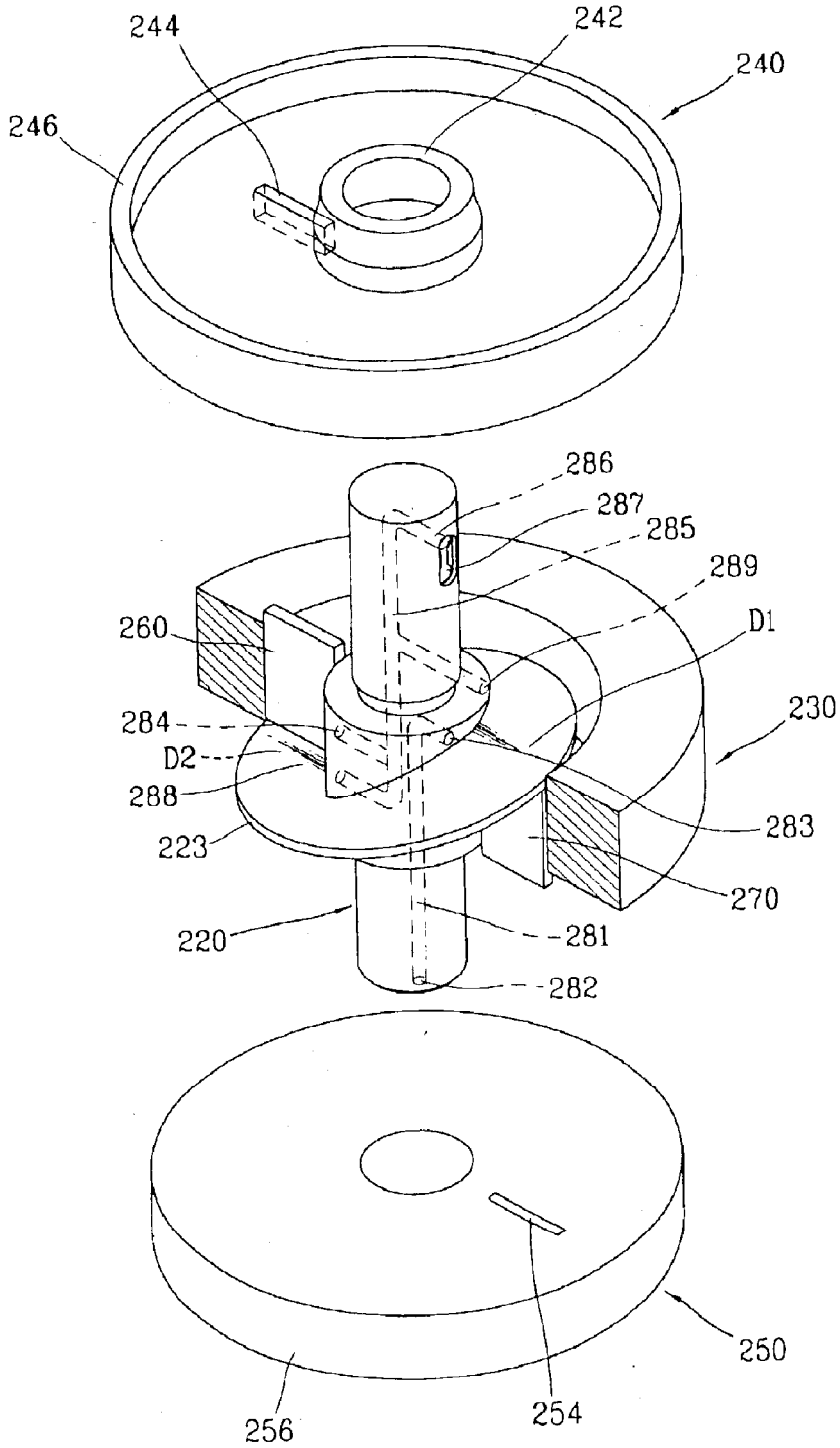
FIG. 6 is a perspective view showing a part of a compression unit in the compressor shown in FIG. 5.
Figure 7:
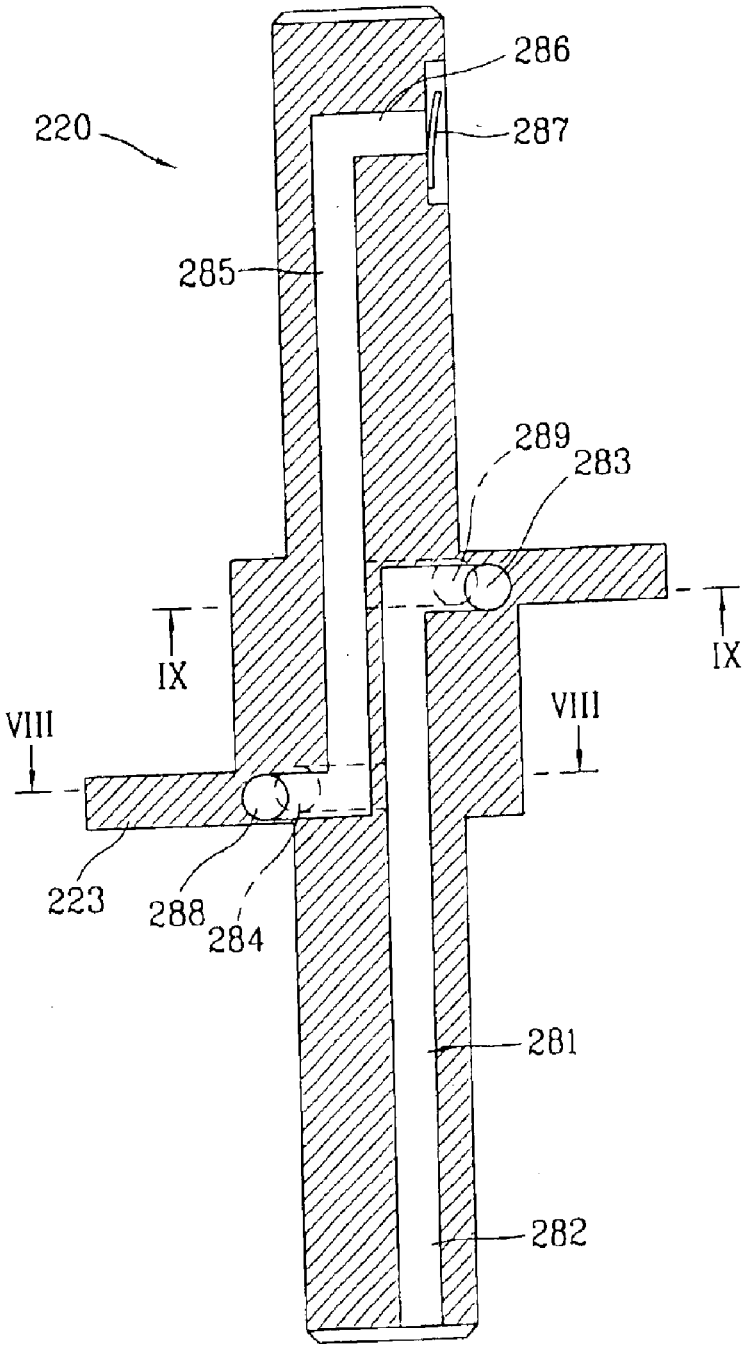
FIG. 7 is a longitudinal cross-sectional view showing a supporting shaft of the compressor shown in FIG. 5.

FIG. 5 is a longitudinal cross-sectional view showing a compressor according to the present invention, FIG. 6 is a perspective view showing a part of a compression unit in the compressor shown in FIG. 5.

As shown in FIGS. 5 and 6, the compressor according to the present invention roughly comprises a sealed chamber 210 to which a suction pipe 201 and a discharge pipe 202 are connected, a motor unit 212 disposed in the sealed chamber 210 for generating a driving force, and a compression unit 214 inserted into the motor unit 21 for compressing compressible fluid.

The motor unit 212 comprises a stator 216 fixedly adhered to an inner circumferential surface of the sealed chamber 210, and a rotor 218 disposed to maintain a certain air gap with the stator 216 to be rotated by an electromagnetic interaction with the stator 216.

The compression unit 212 comprises a cylinder assembly 231 fixedly adhered to an inner circumferential surface of the rotor 218 to be rotated with the rotor 218 and form a compression space therein, a supporting shaft 220, which is penetrated by the cylinder assembly 231, having both sides fixed on the sealed chamber 210 to support the cylinder assembly 231 to be rotatable, a cam member 223 coupled to the supporting shaft 220 in the cylinder assembly 231 for dividing a sealed space in the cylinder assembly 231 into a first space (V1) and a second space (V2), and a first and a second vanes 260 and 270 contacted to both side surfaces of the cam member 223 and rotated centering around the supporting shaft 220 by the rotation of the cylinder assembly 231 for dividing the first and the second spaces (V1 and V2) into suction areas and compression areas respectively.

The cylinder assembly 231 comprises a cylinder 230, and a first and a second bearing plates 240 and 250 fixed on both sides of the cylinder 230 for forming the compression space (V) with the cylinder 230.

The first and second bearing plates 240 and 250 are formed as discs having predetermined thickness and area, and comprise journal portions 242 and 252 into which the supporting shaft 220 is inserted. The journal portions 242, 252 penetrate on the center and have predetermined height and outer diameter. First and second vane slots 244 and 254 are penetratingly formed on one sides of the journal portions, to which the first and second vanes 260 and 270 are slidingly inserted.

Also, it is desirable that the first and second bearing plates 240 and 250 form coupling protrusive portions 246 and 256 which are protruded vertically from an outer circumference of the first and second bearing plates in order to increase contacting area with the inner circumferential surface of the rotor 218. The cam member 223 is formed as a disc when it is projected on a plane so that the outer circumferential surface thereof contacts to the cylinder 230 as sliding on the inner circumferential surface of the cylinder 230, and formed as cam surface of sinuous wave having same thickness from the inner circumferential surface to the outer circumferential surface when the side surface is projected. In addition, when the cylinder assembly 231 is rotated, a surface making a top dead center (D1) is slid on the lower surface of the first bearing plate 240, and a surface making a bottom dead center (D2) is slid on the upper surface of the second bearing plate 250.

The first and second vanes 260 and 270 are formed as square plates, and disposed to be adhered with the sinuous wave surface of the cam member 223 in the compression space (NI) of the cylinder assembly 231. On the other hand, it is desirable that an insulator 237 of cylindrical shape is disposed between the cylinder assembly 231 and the rotor 218 so that compressive heat generated from the cylinder assembly 231 or motor heat generated from the rotor 218 can not be transmitted to each other. The insulator 237 may be made of a ceramic composite material or other materials having the desired insulating properties.

As shown in FIG. 5, the supporting shaft 220 is coupled to both sides of the sealed chamber 210 by welding or bolting, and formed to have a certain outer diameter and a predetermined length to support the cylinder assembly 231 to be rotatable.

Also, the cam member 223 is coupled to center portion of the supporting shaft 220, and a suction passage 281 through which the fluid is sucked into the cylinder assembly 231 and a discharge passage 285 through which the compressed fluid is discharged are formed on the supporting shaft 220.

Herein, the suction passage 281 is connected to the suction pipe 201 when the supporting shaft 220 is coupled to the sealed chamber 210.

Also, the suction passage 281 is formed to be branched to upper and lower directions so as to be communicated with outlets 283 and 284 which are formed on the first and second spaces of the cylinder assembly 231 as penetrating from an inlet 282 of the suction passage 281 to the center of supporting shaft 220.

In addition, the discharge passage 285 has inlets 288 and 289 formed on the first and second spaces near the outlets 283 and 284 of the suction passage 281, and an outlet 286 of the discharge passage 285 is formed as penetrating the upper outer circumferential surface of the supporting shaft 220. Herein, a discharge valve 287 is mounted on the outlet 286 of the discharge passage 285 for preventing backflow of the compressed fluid.

Figure 8:
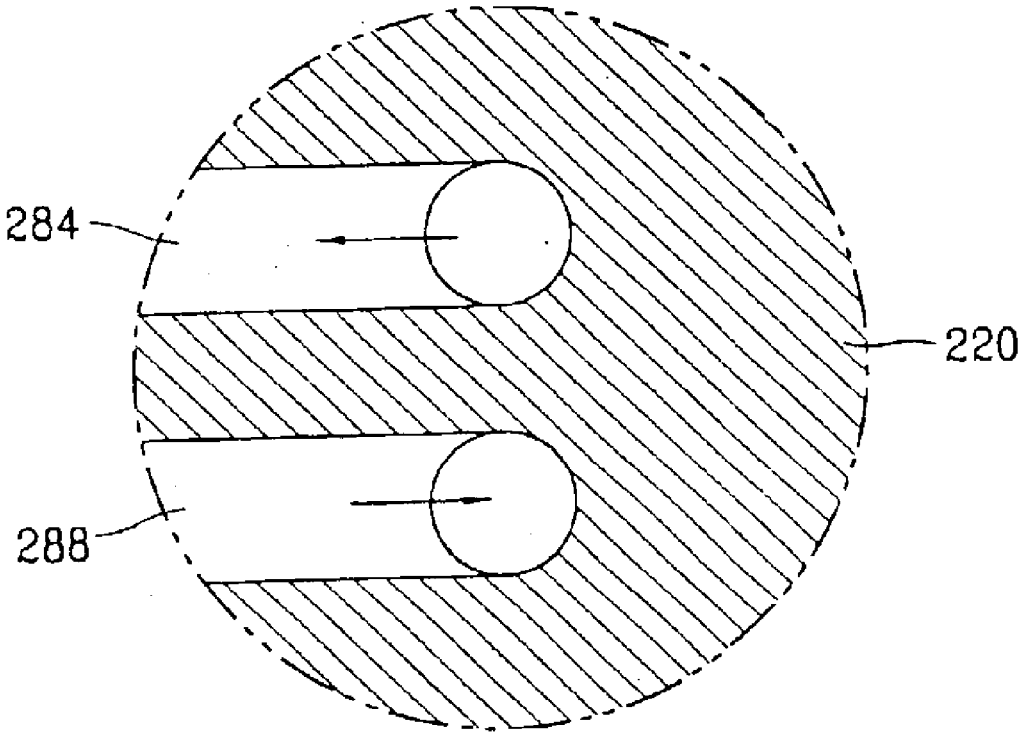
FIG. 8 is a cross-sectional view in line VIII—VIII direction in FIG. 7.
Figure 9:
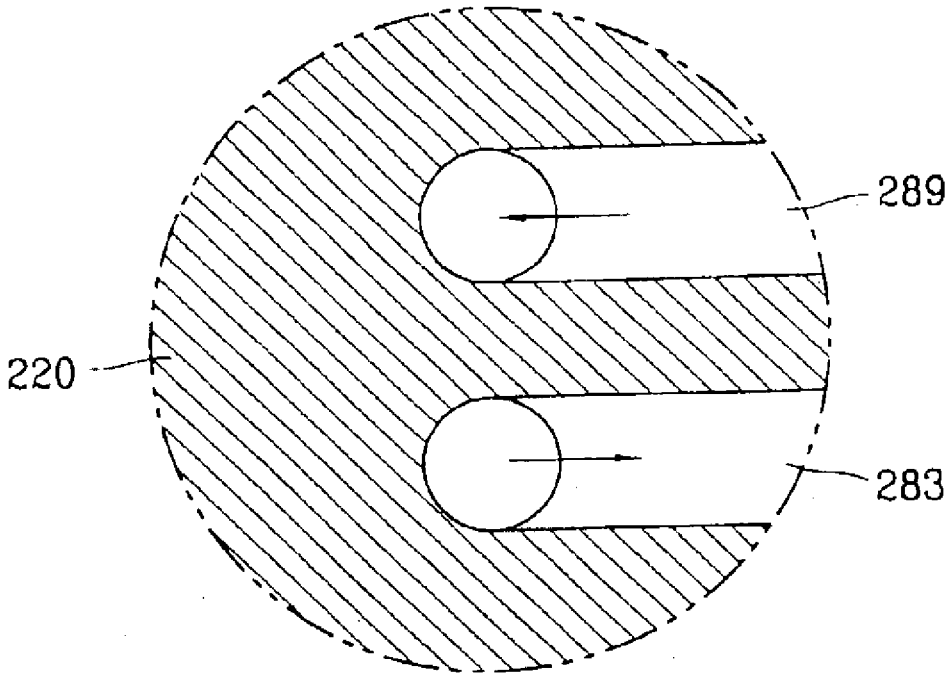
FIG. 9 is a cross-sectional view in line IX—IX direction in FIG. 7.

As shown in FIGS. 8 and 9, it is desirable that the suction passage 281 and the discharge passage 285 are formed parallelly with each other having a certain gap therebetween since the outlets 283 and 284 and the inlets 288 and 289 are formed on same heights as each other and some portions are overlapped in length direction of the supporting shaft 220.

Operations of the compressor according to the embodiment of the present invention constructed as above will be described as follows.

First, the cylinder assembly 231 which is fixedly adhered to the inner circumferential surface of the rotor 218 is rotated by the rotating force of the motor unit 212. At that time, the cam member 223 is fixedly coupled to the supporting shaft 220 in the cylinder assembly 231.

In addition, the first and second vanes 260 and 270 which are inserted into the first and second vane slots 244 and 254 of the cylinder assembly 231 are rotated centering around the supporting shaft 220 by the rotation of the cylinder assembly 231, and reciprocates along with the sinuous cam surface of the cam member 223, respectively.

At that time, the fist space (V1) located on upper part of the cam member 223 is divided into the suction area and the compression area as making the top dead center (D1) of the cam member 223 and the first vane 260 boundary, and the second space (V2) located on lower part of the cam member 223 is divided into the suction area and the compression area as making the bottom dead center (D2) of the cam member 223 and the second vane 270 boundary.

In above status, the cylinder assembly 231 is rotated and the cam member 223 is in fixed status, and accordingly, volumes of the suction areas and the compression areas in the fist and second space (V1 and V2) for the top dead center (D1) and the bottom dead center (D2) of the cam member 223 are variable.

Therefore, the compressible fluid is sucked into the respective suction areas of the first and second spaces (V1 and V2) through the suction passage 281 which is formed as penetrating the supporting shaft 220, gradually compressed, and discharged out of the cylinder assembly 231 through the discharge passage 285 formed as penetrating the supporting shaft 220 at the moment when the top dead center (D1) or the bottom dead center (D2) of the cam member 223 reaches to a discharge starting point.

In addition, the fluid discharged as above is exhausted to outer side of the compressor through the discharge pipe 202 communicated with the sealed chamber 210.

In the compressor constructed and operated as above according to one embodiment of the present invention, the compression unit is adhered and fixed in the rotor of the motor unit, and therefore, the noise and vibration caused by the moment of inertia on the rotary shaft in the conventional compressor can be prevented.

Also, since the height of the journal portions formed on the bearing plates can be reduced, the frictional area between the supporting shaft and the bearing plate is reduced, and therefore, the function degradation of compressor caused by the friction can be prevented.

Also, the compressor according to one embodiment of the present invention can be reduced its size in length direction, and therefore, the installation space required by the compressor is reduced. Therefore, the device in which the compressor is installed can be compact and have low weight.

On the other hand, a compressor according to another embodiment of the present invention will be described with reference to FIG. 10 as follows. Hereinafter, for same components as those of the above embodiment, same reference numerals will be used and descriptions for those will be omitted.

Figure 10:
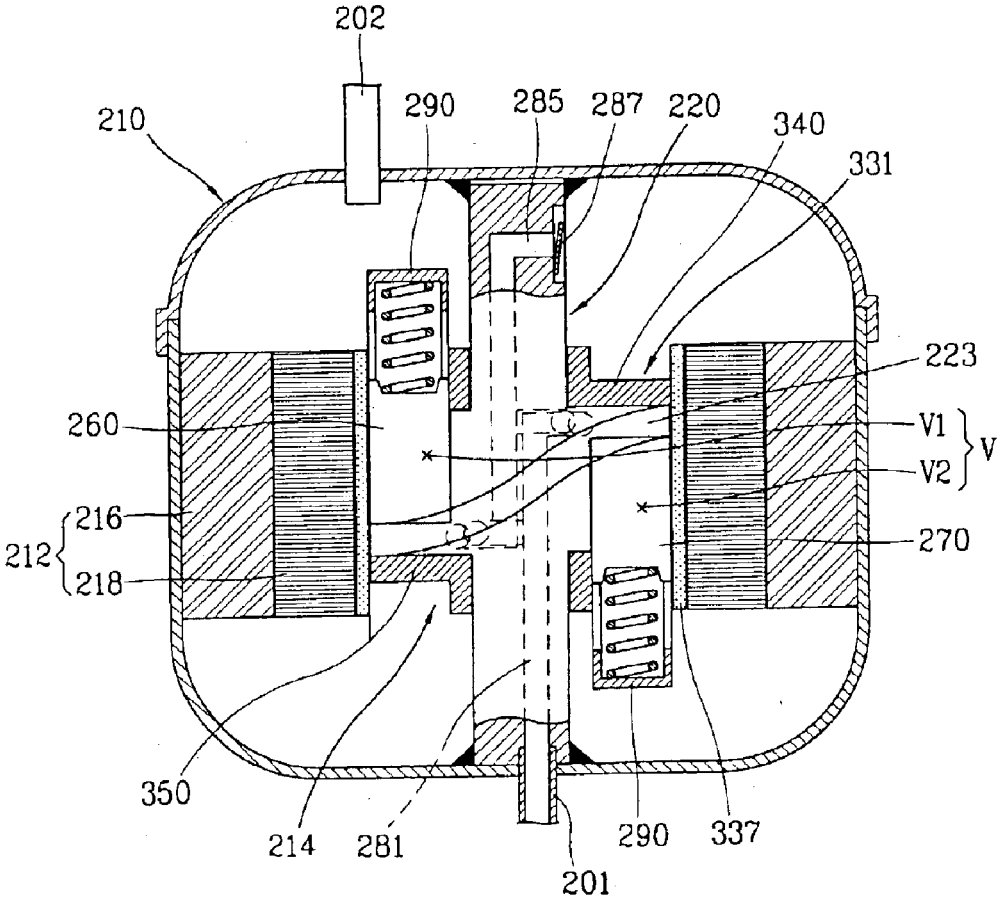
FIG. 10 is a longitudinal cross-sectional view showing a compressor according to another embodiment of the present invention.

FIG. 10 is a longitudinal cross-sectional view showing the compressor according to another embodiment of the present invention.

In the compressor according to the first embodiment of the present invention, the cylinder assembly 231 having the compression space (V) in which the fluid is compressed comprises the cylinder 230 and the first and second bearing plates 240 and 250 fixed on both sides of the cylinder 230. However, in the compressor according another embodiment of the present invention, an inner space of a cylinder assembly 331 is formed using an inner circumferential surface of the rotor 218 unlike in the first embodiment.

That is, a first bearing plate 340 and a second bearing plate 350 are fixed on upper and lower sides of the rotor 218 with a certain interval, and thereby the cylinder 230 in the first embodiment can be omitted.

Also, an insulator 337 is disposed between the rotor 218 and the cylinder assembly 331, and thereby, the compression space (V) can be formed by the insulator 337 and the first and second bearing plates 340 and 350.

In the compressor constructed as above according to the another embodiment of the present invention, the cylinder is omitted and the compression space (V) is formed using the bearing plates 340 and 350 and the rotor 218 (more particularly, the insulator 337). Therefore, the number of components is reduced less than that of the compressor according to the first embodiment, and the structure is simple to reduce production cost and to improve productivity.

On the other hand, a compressor according to still another embodiment of the present invention will be described with reference to FIGS. 11 and 12 as follows.

Figure 11:
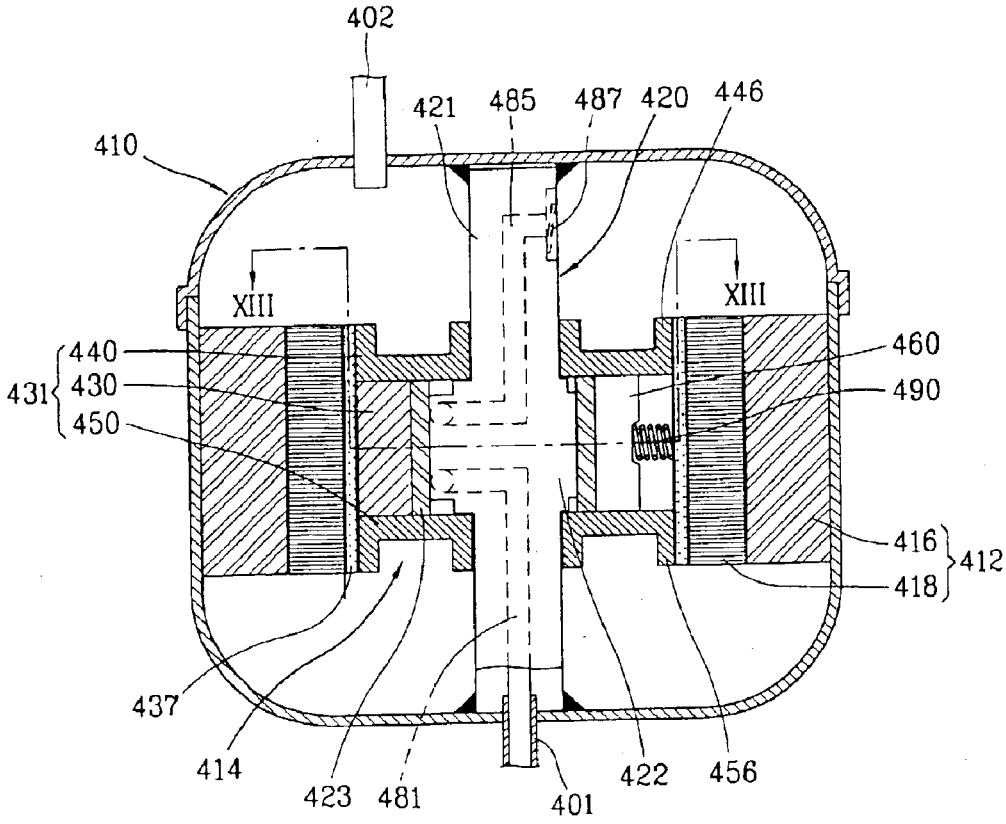
FIG. 11 is a longitudinal cross-sectional view showing a compressor according to still another embodiment of the present invention.
Figure 12:
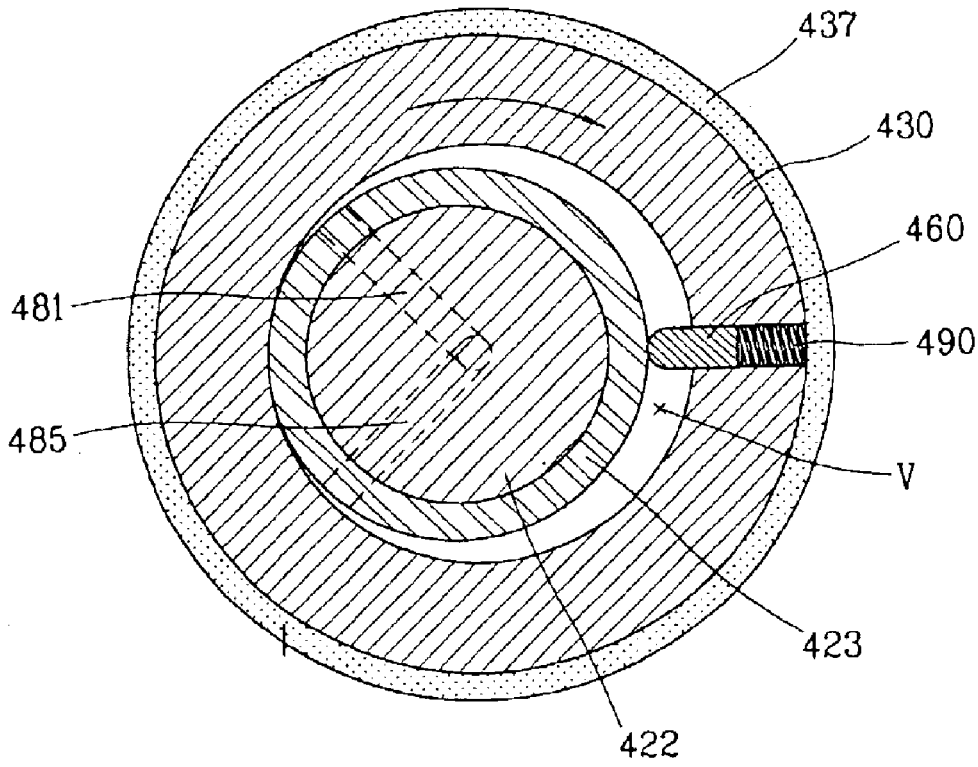
FIG. 12 is a cross-sectional view in line XII—XII direction in FIG. 11.

FIG. 11 is a longitudinal cross-sectional view showing the compressor according to still another embodiment of the present invention, and FIG. 12 is a cross-sectional view in line XII—XII of FIG. 11.

The compressor according to still another embodiment of the present invention comprises a sealed chamber 410 to which a suction pipe 401 and a discharge pipe 402 are communicated, a motor unit 412 fixed in the sealed chamber 410 for generating rotating force, and a compression unit 414 received in the motor unit 412 for sucking, compressing and discharging compressible fluid by being transmitted the rotating force generated by the motor unit 412.

The motor unit 412 comprises a stator fixedly adhered to an inner circumferential surface of the sealed chamber 410, and a rotor 418 disposed apart a certain air gap from the stator 416 for generating rotating force by an electromagnetic interaction with the stator 416.

Herein, the stator 416 may be fixed on the inner circumferential surface of the sealed chamber 410 using a method such as welding or bolting.

The compression unit 414 comprises a cylinder assembly 431 fixedly adhered to the inner circumferential surface of the rotor 418 to be rotated with the rotor 418 and having a compression space (V), a supporting shaft 420 having both sides fixed on inner side of the sealed chamber 410, a suction passage 481 and a discharge passage 485 therein for supporting the cylinder assembly 431 to be rotatable, a cam member 423 coupled eccentrically to an outer circumferential surface of the supporting shaft 420 and disposed so that one side thereof contacts to the inner diameter of the cylinder assembly 431, and a vane 460 having one surface contacted to the cam member 423, rotated centering around the supporting shaft 420 and reciprocated along with a cam surface of the cam member 423 to divide the compression space (V) into a suction area and a compression area when the cylinder assembly 431 is rotated.

The cylinder assembly 431 comprises a cylinder 430, and a first and a second bearing plates 440 and 450 fixed on both sides of the cylinder 430 to form the compression space (V) with the cylinder 430.

A vane slot 444 is formed as cut in the cylinder 430 for guiding the reciprocating movements of the vane 460, and an elastic supporting means 490 for elastically supporting the vane 460 from outer side of the vane slot 444 is disposed in the cylinder 430.

In addition, the discharge passage 485 through which the compressed fluid is discharged is formed on one side of the inner circumferential surface, where the cylinder 430 and the first bearing plate 440 are contacted, as communicating with the compression space (V).

On the other hand, it is desirable that an insulator 437 of cylindrical shape is disposed between the cylinder assembly 431 and the rotor 418 so that compressive heat generated from the cylinder assembly 431 or motor heat generated from the rotor can not be transmitted to each other.

The supporting shaft 420 is fixed by welding both sides on the sealed chamber 410 or may be fixed in bolting method.

The suction passage 481 is communicated with the suction pipe 401 when the supporting shaft 420 is fixed on the sealed chamber 410, and a discharge valve 487 is mounted on outlet side of the discharge passage 485. On the other hand, the cam member 423 can be coupled to the supporting shaft 420 integrally.

The vane 460 is elastically supported by the elastic supporting member 490 fixed on outer circumferential side of the cylinder assembly 431, moved with the cylinder assembly 431 in a state of contacting to the cam member 423 when the cylinder assembly 431 is rotated, and reciprocated in radial direction of the cylinder assembly 431 along with the cam surface of the cam member 423.

Operations and effects of the compressor according to the still another embodiment of the present invention will be described as follows.

First, when the electric power is applied to the stator 416, the rotor 418 is rotated by the electromagnetic interaction with the stator 416.

In addition, the cylinder assembly 431 fixedly adhered to the inner circumferential surface of the rotor 418, and the vane 460 elastically supported by the outer circumferential surface of the cylinder assembly 431 is moved to outer circumferential direction with the cylinder assembly 431.

At that time, the cam member 423 coupled to eccentric portion 422 of the supporting shaft 420 maintains stopped status in the cylinder assembly 431, and therefore, the vane 460 is moved along with the cam surface of the cam member 423 to be reciprocated in radial direction of the cylinder assembly 431. Therefore, a volume of the compression space (V) of the cylinder assembly 431 is changed by the cam member 423 and the vane 460, and therefore, the compressible fluid induced into the compression space through the suction passage 481 is compressed and discharged through the discharge passage 485.

In addition, the compressible fluid discharged as above is exhausted to outer side of the compressor through the discharge pipe 402.

In the compressor according to the present embodiment, the cylinder assembly having the vane rotates with the rotor to change volumes of the suction area and the compression area therein, and the vane rotates with the cylinder to form the compression space for sucking, compressing and discharging the compressible fluid, as in the compressor according to the first embodiment.

Therefore, the compressor according to the still another embodiment of the present invention is able to obtain the effects of the previous embodiments. In the compressor according to the present invention, the compression unit is installed in the motor unit to reduce the size of the compressor in length direction, and therefore, the installation space required by the compressor can be reduced and entire size of a device in which the compressor is used can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A compressor comprising:

a sealed chamber to which a suction pipe and a discharge pipe are coupled;

a motor fixed in the sealed chamber and comprising a stator and a rotor for generating rotating force by an electromagnetic interaction between the stator and the rotor;

a cylinder assembly fixed on an inner circumferential surface of the rotor to be rotated with the rotor, and forming a compression space therein;

a supporting shaft having ends fixed on inner surfaces of the sealed chamber to support the cylinder assembly such that the cylinder assembly is rotatable on the supporting shaft, a suction passage for supplying fluid into the compression space and a discharge passage for discharging the compressed fluid;

a cam member fixed on the supporting shaft located in the cylinder assembly, wherein the cam member has a circular profile when viewed from above or below such that an outer periphery of the cam member is in slidable contact with the cylinder around substantially the entire circumference of the cam member; and at least one vane fixed on the cylinder assembly to be rotated with the cylinder assembly, wherein the at least one vane contacts a surface of the cam member as the cylinder rotates to compress and discharge a fluid through the discharge passage.

2. The compressor of claim 1, wherein the cam member is formed integrally on the supporting shaft, wherein the cam member is formed as a disc when it is projected on a plane, wherein the cam member has a top dead center and bottom dead center, and wherein the at least one vane slides on a surface of the cam member as the cylinder assembly rotates.

3. The compressor of claim 2, wherein the at least one vane comprises first and second vanes, and wherein the cylinder assembly comprises:

a cylinder having an outer side surface fixedly adhered to an inner circumferential surface of the rotor;

an upper bearing plate fixed on an upper part of the cylinder having a lower surface constructing the compression space and a vane slot in which the first vane is inserted; and a lower bearing plate fixed on a lower part of the cylinder having an upper surface constructing the compression space and a vane slot in which the second vane is inserted.

4. The compressor of claim 3, wherein the upper bearing plate includes a coupling protrusive portion that protrudes up from an outer brim of the upper bearing plate so that an adhering area with the inner circumferential surface of the rotor can be increased.

5. The compressor of claim 3, wherein the lower bearing plate includes a coupling protrusive portion that protrudes down from an outer brim of the lower bearing plate so that an adhering area with the inner circumferential surface of the rotor can be increased.

6. The compressor of claim 1, wherein an insulator is disposed between the inner circumferential surface of the rotor and the outer circumferential surface of the cylinder assembly so as to reduce heat exchange between the cylinder and the rotor.

7. The compressor of claim 6, wherein the insulator is made of ceramic composite material.

8. The compressor of claim 2, wherein the at least one vane comprises first and second vanes, and wherein the cylinder assembly comprises:

a cylinder formed as an insulator to reduce heat exchange between the cylinder assembly and the rotor, and having an outer circumferential surface fixedly adhered to an inner circumferential surface of the rotor;

an upper bearing plate fixedly adhered to an upper surface of the cylinder, having a lower surface constructing the compression space and a vane slot in which the first vane is inserted; and a lower bearing plate fixed on an lower surface of the cylinder, having an upper surface constructing the compression space and a second vane slot in which the second vane is inserted.

9. The compressor of claim 8, wherein the upper bearing plate includes a coupling protrusive portion that protrudes up from an outer brim of the upper bearing plate so that an adhering area with the inner circumferential surface of the rotor can be increased.

10. The compressor of claim 8, wherein the lower bearing plate includes a coupling protrusive portion that protrudes up from an outer brim of the lower bearing plate so that an adhering areas with the inner circumferential surface of the rotor can be increased.

11. The compressor of claim 1, wherein the supporting shaft comprises:

at least one suction passage having an inlet coupled with the suction pipe and an outlet coupled to an inner space of the cylinder assembly; and at least one discharge passage having an inlet coupled to the inner space of the cylinder assembly an outer penetrating an outer circumferential surface of the supporting shaft.

12. The compressor of claim 11, wherein a discharge valve is mounted on the outlet of the discharge passage for preventing backflow of discharged fluid.

* * * * *